US009802104B2

(12) United States Patent
Cox

(10) Patent No.: US 9,802,104 B2
(45) Date of Patent: Oct. 31, 2017

(54) RETICULATED DIGIT SHIELD FOR PROTECTIVE SPORTS GLOVE

(71) Applicant: Michael G. Cox, Felton, PA (US)

(72) Inventor: Michael G. Cox, Felton, PA (US)

(73) Assignee: WM. T. BURNETT IP, LLC, Baltimore, MD (US)

( * ) Notice: Subject to any disclaimer, the term of this patent is extended or adjusted under 35 U.S.C. 154(b) by 746 days.

(21) Appl. No.: 14/205,207

(22) Filed: Mar. 11, 2014

(65) Prior Publication Data

US 2015/0033432 A1 Feb. 5, 2015

Related U.S. Application Data

(60) Provisional application No. 61/862,280, filed on Aug. 5, 2013.

(51) Int. Cl.

| | |
|---|---|
| ***A41D 19/00*** | (2006.01) |
| ***A63B 71/14*** | (2006.01) |
| *A63B 102/24* | (2015.01) |
| *A63B 102/14* | (2015.01) |
| *A63B 102/22* | (2015.01) |

(52) U.S. Cl.

CPC ..... *A63B 71/141* (2013.01); *A63B 71/143* (2013.01); *A63B 2102/14* (2015.10); *A63B 2102/22* (2015.10); *A63B 2102/24* (2015.10); *A63B 2209/00* (2013.01)

(58) Field of Classification Search

CPC ..... A41D 13/087; A41D 19/01588; A41D 19/01582; A63B 71/141

See application file for complete search history.

(56) References Cited

U.S. PATENT DOCUMENTS

| | | | | |
|---|---|---|---|---|
| 381,687 | A * | 4/1888 | Fischer | A63B 71/143 2/19 |
| 1,951,190 | A * | 3/1934 | Gambee | D05B 91/04 2/21 |
| 4,272,849 | A * | 6/1981 | Thurston | A41D 19/01517 2/16 |
| 4,507,804 | A * | 4/1985 | Consigny | A41D 13/087 2/163 |
| 4,829,988 | A * | 5/1989 | Caminiti | A61H 1/008 602/22 |

(Continued)

*Primary Examiner* — Richale Quinn

(74) *Attorney, Agent, or Firm* — Baker Donelson, PC; Royal W. Craig

(57) ABSTRACT

A protective digit shield for a protective sports glove, the shield having a hard chassis portion and an energy absorbing portion forming a hinge. The chassis portion provides an arcuate channel in which the thumb/digit is received. The chassis is segmented along the longitudinal axis to provide a proximal portion and a distal portion corresponding generally with the proximal and distal phalanx bones of the thumb/digit. A resilient, energy absorbing element along the channel provides separation between the chassis and forms a living hinge such that the chassis can rotate. The energy absorbing element may also include a damping element along opposing edges at the segmented joint to absorb and dissipate forces and prevent hyperextension. In an alternate embodiment, the energy absorbing element is replaced with a connection cable for connecting the portions of the chassis.

25 Claims, 7 Drawing Sheets

(56) References Cited

U.S. PATENT DOCUMENTS

| | | | | |
|---|---|---|---|---|
| 6,684,406 | B2 * | 2/2004 | Fowler | A41D 13/084 2/16 |
| 7,320,145 | B2 * | 1/2008 | Hochmuth | A41D 19/01523 2/161.1 |
| 7,574,748 | B2 * | 8/2009 | Fisher | A41D 19/01588 2/16 |
| 7,797,758 | B2 * | 9/2010 | Keppler | A41D 19/01588 128/878 |
| 7,802,315 | B2 * | 9/2010 | Contant | A63B 71/143 2/16 |
| 7,937,774 | B1 * | 5/2011 | King | A41D 13/087 2/161.1 |
| 8,028,347 | B2 * | 10/2011 | Chang | A41D 19/01588 2/161.1 |
| 8,037,549 | B2 * | 10/2011 | Saur | A41D 19/01582 2/455 |
| 8,181,275 | B2 * | 5/2012 | Saturnio | A41D 19/01588 2/16 |
| 8,191,174 | B2 * | 6/2012 | Winningham | A41D 13/0005 2/161.1 |
| 8,341,763 | B2 * | 1/2013 | Geyer | A41D 19/01588 2/160 |
| 8,490,215 | B2 * | 7/2013 | Mueller | A41D 19/01588 2/161.1 |
| 8,516,612 | B2 * | 8/2013 | Lynn | A41D 13/087 2/21 |
| 8,918,913 | B2 * | 12/2014 | Power | A41D 13/087 2/16 |
| 9,420,836 | B1 * | 8/2016 | Madden, Jr. | A41D 19/01594 |
| 2009/0222967 | A1 * | 9/2009 | Winningham | A41D 13/0005 2/21 |

* cited by examiner

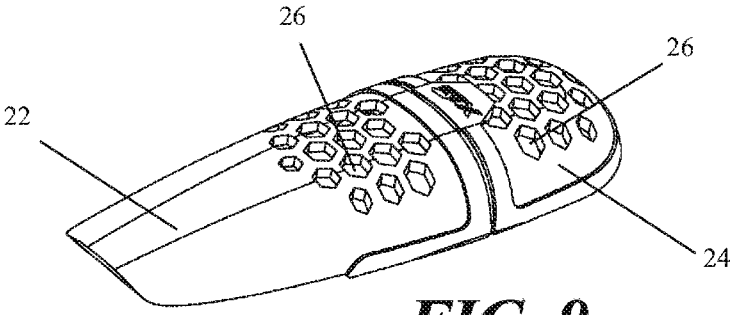
FIG. 9
FIG. 10
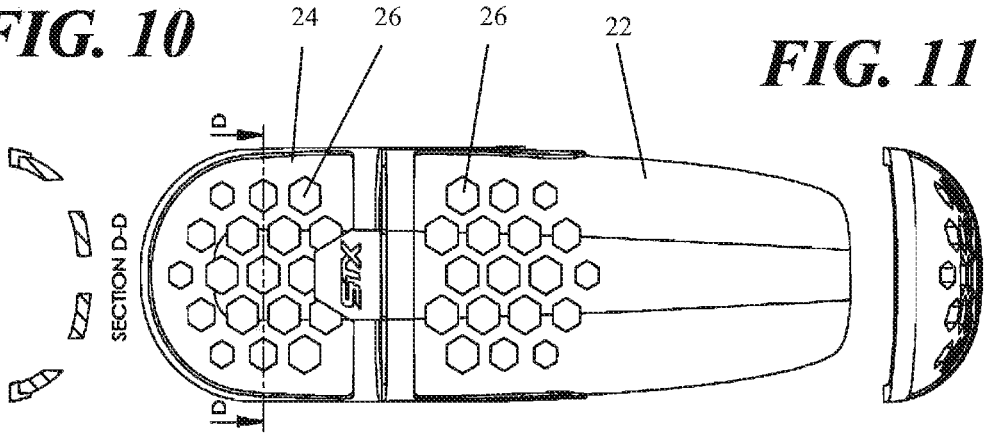
FIG. 11
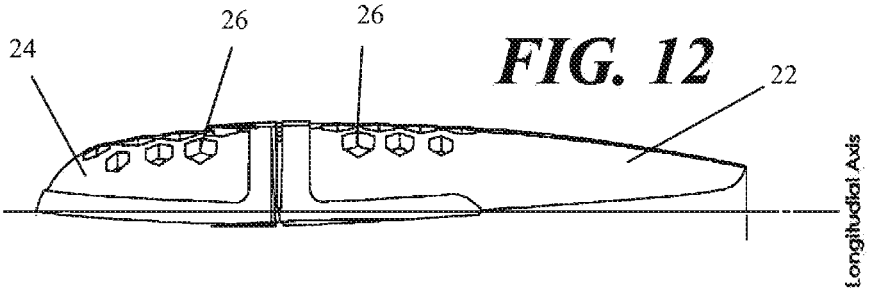
FIG. 12

RETICULATED DIGIT SHIELD FOR PROTECTIVE SPORTS GLOVE

CROSS-REFERENCE TO RELATED APPLICATION

This application claims the benefit under 35 U.S.C. §119 (e) of U.S. Provisional Patent Application Ser. No. 61/862,280, filed Aug. 5, 2013, which is incorporated herein by reference.

BACKGROUND OF THE INVENTION

1. Field of the Invention

The present invention relates generally to protective gloves for contact sports and, more particularly, to a protective insert for a sports glove for protection of the digits of the hand, and even more particularly to a reticulated shield-insert for protection of the thumb in a hockey glove.

2. Description of the Background

Protective sports gloves are commonly used and, indeed, are required to be used in many organized sports such as lacrosse, hockey and other contact sports. Such gloves protect the wearer from the impact of lacrosse sticks, hockey sticks, balls, pucks, skates, and other players or obstructions. Contact between the hand and, in particular the fingers or thumb and these items or the playing surface can cause injury. Finger injuries are common in sports with the most common injury being a sprain to one of the ligaments located within the finger or thumb. Each finger has three small bones (phalanges) separated by two interphalangeal joints. Starting from the tip of the finger, the bones are referred to as the distal, medial and proximal phalanges and the joints as the distal and proximal interphalangeal joints. The thumb is unique and has one interphalangeal joint and only two small phalanx bones, the distal and proximal phalanges.

A sprain is an injury to a ligament or the joint capsule surrounding a joint. Each of the joints located in the thumb or finger have collateral ligaments that run along each side of the joints. It is these collateral ligaments that are commonly sprained in sports. The most common mechanism of a sprained digit is a blow to the end of a finger or thumb such as, for example, by a puck moving at high speed. The force of the blow at the end of the finger reverberates up the finger to the joint causing the joint to either hyperextend or move laterally, causing injury to the collateral ligaments in the fingers. A hockey player's thumb is at most risk for injury because the grip required to hold the hockey stick fully and individually exposes the thumb, and because the two smaller phalanx bones are relatively fragile.

Another mechanism of injury in sports is catching a finger in a jersey or piece of sports equipment. If the force is stronger than the tensile strength of the ligament, the ligament can be stretched or torn. Falls to the playing surface are another common cause of digit sprains as players extend their hands to stop their fall. Finally, in stick sports such as hockey or lacrosse, checking across the hand by another player can cause traumatic injury and sprain to the hands if they are not properly protected.

Conventional protective sports gloves for stick sports position pad segments (e.g., made of foam) on the back (dorsal) side of the hand that are covered with fabric or fabric-like material and, in the breaks between the segments, are affixed to one another and to a liner material (also known as the scrim), such as a woven fabric. In these conventional gloves individual foam pads are typically sandwiched between two fabric layers and the layers are sewn together, and to the liner, between breaks in adjacent pads. The padded portions are configured for individual movement of the digits in order to facilitate the free movement and tactile sensation necessary for gripping and maneuvering a shaft such as a lacrosse or hockey stick. Rigid elements, typically of hard plastic, are incorporated at strategic points on and within the glove to enhance protection of the hands and digits, but must be carefully designed and positioned so as not to impede player hand movement, feel of the stick or handling of a puck or ball. When such a protective athletic glove undergoes deformation due to normal articulation of the wearer's digits, adjacent pads and/or hard elements may come into contact with each other to arrest/resist further motion. What is needed is a protective digit insert for a sports glove that absorbs and distributes impact forces from all directions but yet is lightweight and articulated so as to not impede a player's ability to use his thumb and fingers during game play to their fullest ability. A protective digit insert capable of minimizing injury to a hockey player's thumb from airborne pucks traveling at upward of 80-90 mph and hard stick checks, would be particularly advantageous.

SUMMARY OF THE INVENTION

An object of the present invention is to provide a protective digit insert for incorporation into a protective sports glove that is articulated so as to not impede a player's ability to use his or her thumb/digits during game play and which is capable of absorbing and distributing the applied forces from lateral and longitudinal impacts.

These and other objects are achieved by a protective digit shield for inclusion in a protective sports glove having a plurality of hard chassis portions and a reticulated energy-absorbing frame portion partially bounding the hard chassis portions and forming a living hinge element between the chassis portions so as to articulate them for cooperative movement with the thumb of the wearer. The protective digit shield as a whole is shaped to conform to the top of the thumb, e.g., in the form of an inverted arcuate shield hinged at the thumb joint. The hard chassis portions include a proximal portion and a distal portion corresponding generally with the proximal and distal phalanx bones of the thumb/digit. A resilient, energy absorbing layer of elastomeric material is over-molded along at least a portion of the longitudinal edges of both the proximal and distal hard chassis portions to define a reticulated frame, and the resilient frame joins both portions to form a living hinge, such that the distal portion of the chassis can rotate relative to the proximal to accommodate normal motion of the thumb. The elastomeric framework may run upward along opposing edges of and between the proximal and distal portions of the chassis at the segmented joint to form opposing damping elements which absorb and dissipate forces tending to counter rotate the thumb beyond its normal range of motion, and which quiets contact. In certain embodiments the damping elements are omitted in favor of shouldered hinges in which protruding shoulders engage to prohibit unwanted counter-rotation and to dissipate impact forces. Certain embodiments may also include an elastomeric brace that rests into the thumb and index crease of the hand to further distribute impacts on the tip of the thumb.

The present invention is described in greater detail in the detailed description of the invention, and the appended drawings. Additional features and advantages of the invention will be set forth in the description that follows, will be apparent from the description, or may be learned by practicing the invention.

BRIEF DESCRIPTION OF THE DRAWINGS

Other objects, features, and advantages of the present invention will become more apparent from the following detailed description of the preferred embodiments and certain modifications thereof when taken together with the accompanying drawings in which:

FIG. 9 is a perspective view of an alternate embodiment according to the present invention.

FIG. 10 is a composite top and section perspective view of the alternate embodiment according to the present invention of FIG. 9.

FIG. 11 is an end view of the alternate embodiment according to the present invention of FIG. 9.

FIG. 12 is a side view of the alternate embodiment according to the present invention of FIG. 9.

DETAILED DESCRIPTION OF THE PREFERRED EMBODIMENT

Reference will now be made in detail to preferred embodiments of the present invention, examples of which are illustrated in the accompanying drawings. Wherever possible, the same reference numbers will be used throughout the drawings to refer to the same or like parts. The exemplary embodiment will be described in the context of the thumb but those skilled in the art will recognize that the teachings of the exemplary embodiment can be applied to a protective element for each or any digit of the hand.

An embodiment of the present invention provides an articulated rigid protective shield or shield for the thumb. The protective shield will be incorporated within a protective sports glove, typically beneath the glove's padded layer on the dorsal side of the hand, in order to create and maintain a pocket for the thumb of the wearer. The protective shield is specifically designed to limit injury to a hockey player's thumb from stick checks and high-speed pucks impacting the fully exposed thumb while gripping a hockey stick.

Figure 1:
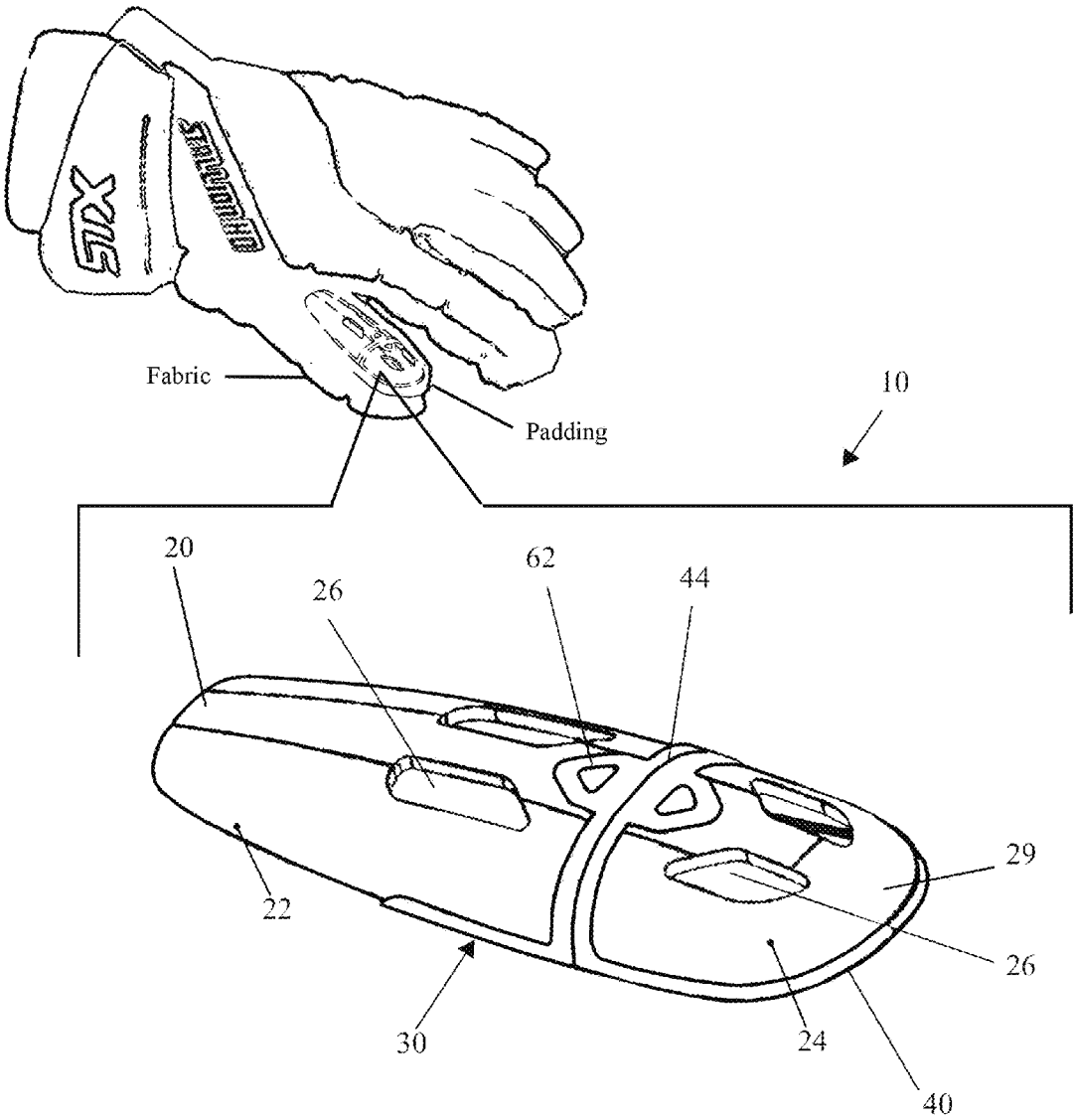
FIG. 1 is a perspective view of an embodiment according to the present invention.

With reference to FIG. 1, a preferred embodiment of the protective digit shield 10 of the present invention includes a rigid sectionalized chassis 20 and relatively more resilient energy absorbing reticulated framework 30 which further facilitates articulation of the chassis 20 of the shield 10.

The chassis 20 includes a proximal portion 22 and a distal portion 24. When incorporated into the protective sports glove the proximal portion 22 extends from the vicinity of the metacarpophalangeal joint between the metacarpal and proximal phalanx bones to the interphalangeal joint between the proximal and distal phalanx bones of the thumb. With additional reference to FIGS. 7 and 8, either or both of the proximal and distal portions 22, 24 of the chassis 20 may be characterized by one or more perforations 26 to lighten and/or vent the digit shield 10 and allow the dissipation of heat and water vapor. The perforations 26 further facilitate over-molding of the energy absorbing reticulated framework 30 as will be described and in integrating the digit shield 10 within the padded glove. In another embodiment, perforations 26 can be of the type and in the pattern shown in FIGS. 9 through 16. The distal end of the proximal portion 22 is joined to the proximal end of the distal portion 22 by a hinge element as will also be described.

Figure 2:
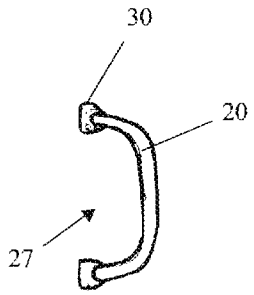
FIG. 2 is a section view of an embodiment according to the present invention.
Figure 3:
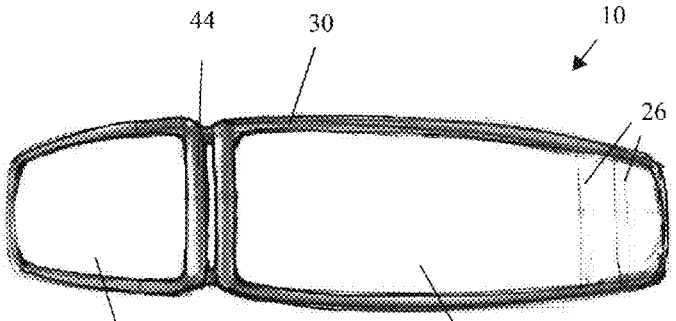
FIG. 3 is a top view of an embodiment according to the present invention.
Figure 7:
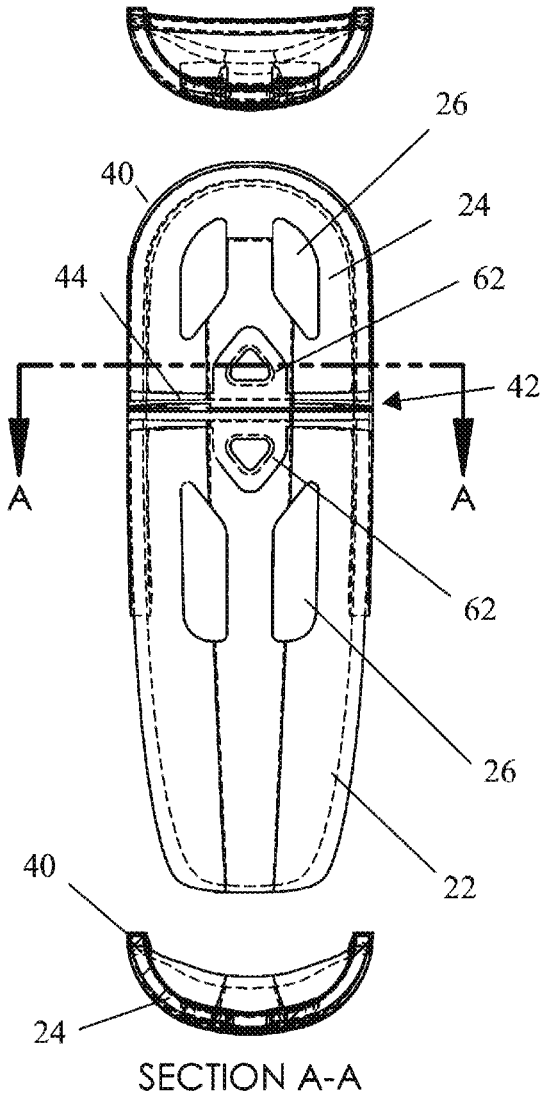
FIG. 7 is composite of transparent top and section views of the present invention.

When incorporated into the protective sports glove, the distal portion 24 of the shield 10 will extend from the vicinity of the interphalangeal joint between the proximal and distal phalanx bones (where it joins the proximal portion 22) to and at least slightly beyond the distal tip of the distal phalanx bone so as to enclose the length of the thumb. With further reference to FIGS. 2, 3 and 7, both the proximal and distal portions 22, 24 of the shield 10 form, in cross section, an arcuate channel 27 having a longitudinal axis roughly parallel to that of the thumb (digit) upon which it seats, and extending to opposing longitudinal edges. The depth of the arcuate channel will vary along the length of the shield 10, having a maximum depth at or near the joint between proximal and distal portions and tapering downward toward the non-adjoining ends of portions 22, 24 where the depth of the channel is slight. From its maximum, the arcuate channel 27 also tapers downward toward the distal end of the distal portion 24 where it goes to zero or is closed off by end wall 29 if desired.

The proximal and distal portions 22, 24 of the chassis 20 are preferably constructed by injection molding or other known process from a relatively rigid, hard plastic polymer such as a thermoplastic polyurethane (TPU) in the nature of Ethylene-vinyl acetate (EVA). Polyvinyl chloride (PVC), polyethylene, acrylonitrile butadiene styrene (ABS) and polypropylene may alternately be used to form the proximal and distal portions 22, 24 of the chassis 20.

With continued reference to FIG. 1 as well as the remaining FIGS. 2-8, the energy absorbing reticulated framework 30 is preferably formed in a unitary fashion of an over-molded elastic polymer, or elastomer. The framework 30 is preferably over-molded to form a reticulated rim 40 around some or all of the longitudinal edges of the channel 27. The rim 40 is over-molded onto the proximal and distal portions 22, 24 in a single molding step so as to form a hinge 42 joining the two portions of the chassis in an articulated manner. Hinge 42 is a "living hinge" which operates by flexure of the material of the rim 40 to thereby permit the distal portion 24 to articulate relative to the proximal portion 22 so as to facilitate motion of the thumb or other digit within the glove. Importantly, the proximal and distal portions 22, 24 of the chassis 20 never directly contact one another. Rather, the shock absorbing reticulated framework 30 separates the distal and proximal portions of the chassis 20 at all times so as to enable the shield 10 to absorb the energy of longitudinal impacts to the thumb (such as an impact jamming the thumb against an object) or lateral to the thumb (such as by a stick check to the hand). The shock absorbing reticulated framework 30 has the additional benefit of permitting a limited degree of longitudinal stretch of shield 10 (by separation of the proximal and distal portions 22, 24) to prevent injury when a digit is caught on and/or pulled by a piece of equipment or clothing of another player.

Figure 4:
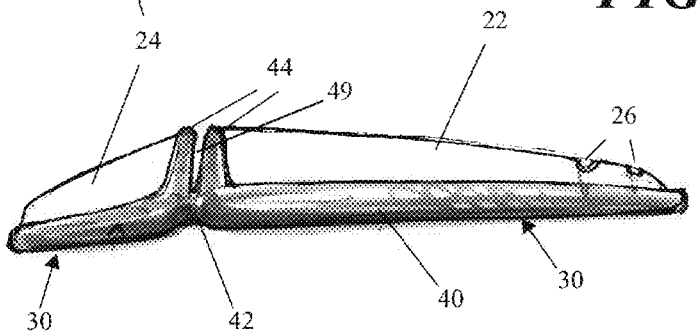
FIG. 4 is a side view of an embodiment according to the present invention.

In the preferred embodiment of FIGS. 1, 3, 4, 6, 7 and 8, the shock absorbing reticulated framework 30 further includes a damping portion 44 extended upward from the hinge 42 along the adjacent ends of the proximal and distal portions 22, 24 of the shield 20. In a rest position as depicted in FIG. 4, a gap 49 of approximately 1 mm is maintained between the two sides of the damping element 44. In use, applied force tending to counter-rotate the hinge 42 is resisted by contact between the two halves of the damping element 44 which thereby prevents extension of the shield and thus the interphalangeal joint. The energy of the applied force is absorbed by elastic deformation of the energy absorbing reticulated framework 30 and of the damping element 44 in particular. Upon removal of the applied force the 1 mm gap is restored. Force applied to the shield 10 longitudinally (as by jamming of the thumb/digit) is likewise absorbed by the energy absorbing reticulated framework 30, and by the hinge 42 and damping element 44 in particular, when necessary.

Figure 8:
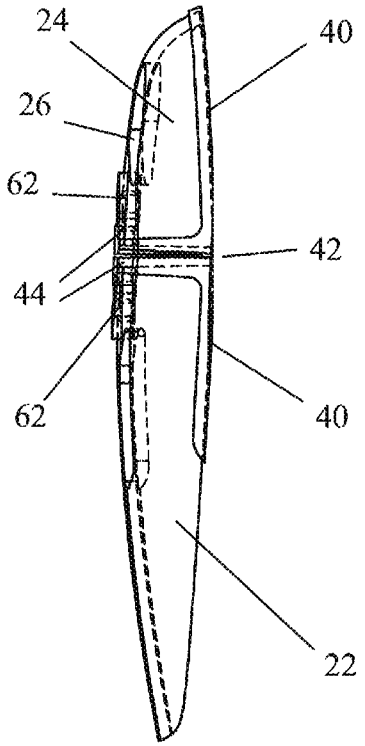
FIG. 8 is a transparent side view of an embodiment according to the present invention.

With reference to FIGS. 1, 7 and 8, in certain embodiments of the shield 10 according to the invention, the damping element 44 will include an energy dissipation block or ring 62 behind one or both damping element halves 44. The dissipation block or ring 62 is preferably integrally formed with the damping element 44 of the energy absorbing reticulated framework 30 and may be situated in a perforation through (or recess formed in) the top surface of the proximal and/or distal portions 22, 24 of the chassis 20. The energy dissipation block or ring 62 provides additional resilient material and surface area contact by which to dissipate the energy in an impact to the hand of the wearer.

Figure 5:
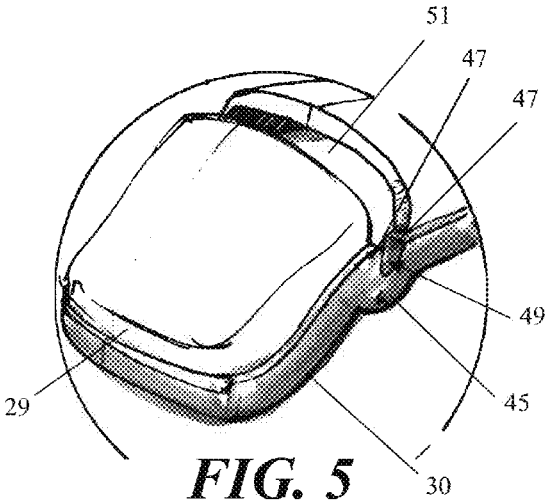
FIG. 5 is a detail perspective view of an alternate embodiment according to the present invention.
Figure 6:
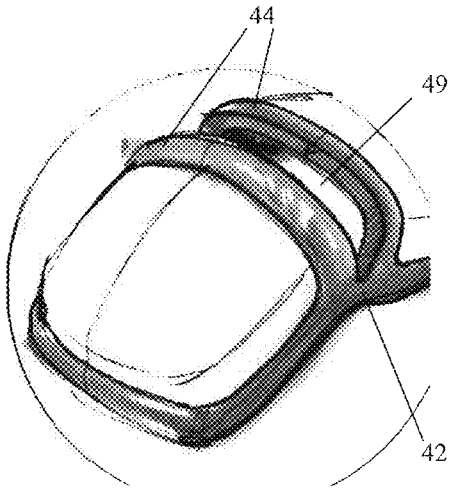
FIG. 6 is a detail perspective view of an embodiment according to the present invention.

With reference to FIG. 5, an alternate embodiment of the present invention is depicted in which the damping element 44 of the prior embodiment is omitted. In the embodiment of FIG. 5, an alternate hinge 45 is provided to facilitate articulation of the proximal and distal portions 22, 24 of the chassis 20. Hinge 45 is formed of the same or similar material as compared to the hinge 42 of the previous embodiment but is formed with a larger, scalloped bifurcation having opposing shoulders 47 on either side of a channel 49 through the energy absorbing reticulated framework 30 at the point of rotation of the distal portion 24 relative to the proximal portion 22. The channels 49 of the hinges 45 on either side of the reticulated framework 30 are cooperatively aligned to provide a single axis of rotation about which the distal portion 24 can rotate relative to the proximal portion 22 of the chassis to accommodate motion of the thumb. Again, the distal and proximal portions 24, 22 are always separated by the energy absorbing framework 30 and never directly contact one another. Rather, a gap 51, here from 1-to-3 mm, is maintained between the distal and proximal portions 24, 22 of the chassis in a rest position and contact between the opposing shoulders 47 prevents over extension of the interphalangeal joint by absorbing the energy on an impact through deformation of the elastomer.

Figure 17:
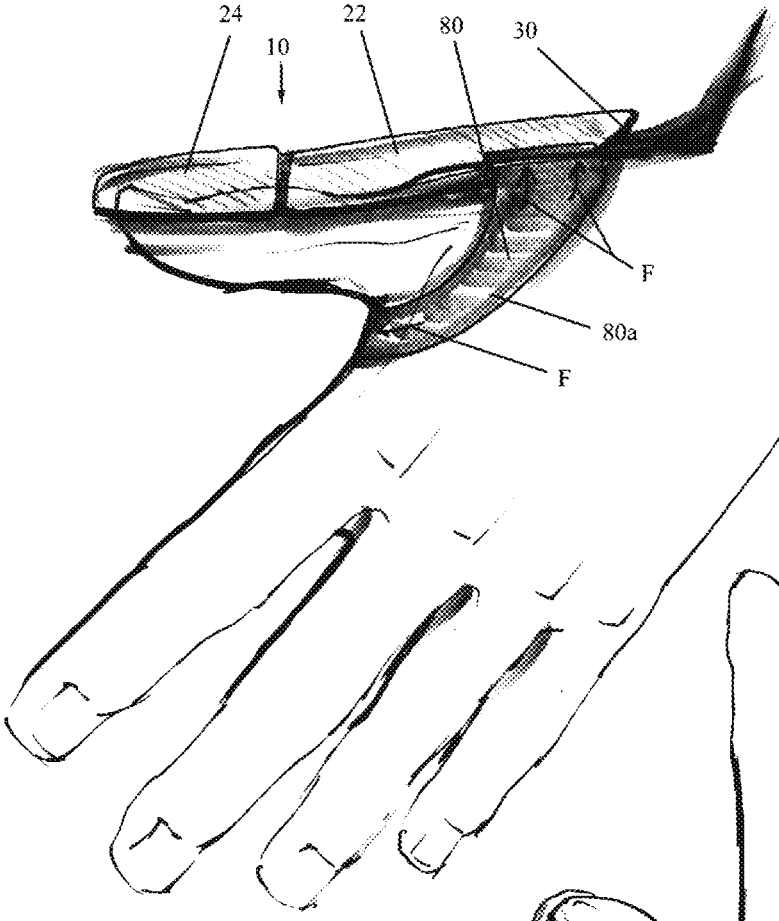
FIG. 17 is a side view of an embodiment of the present invention as it fits onto the hand of a wearer, depicting an optional brace component.
Figure 18:
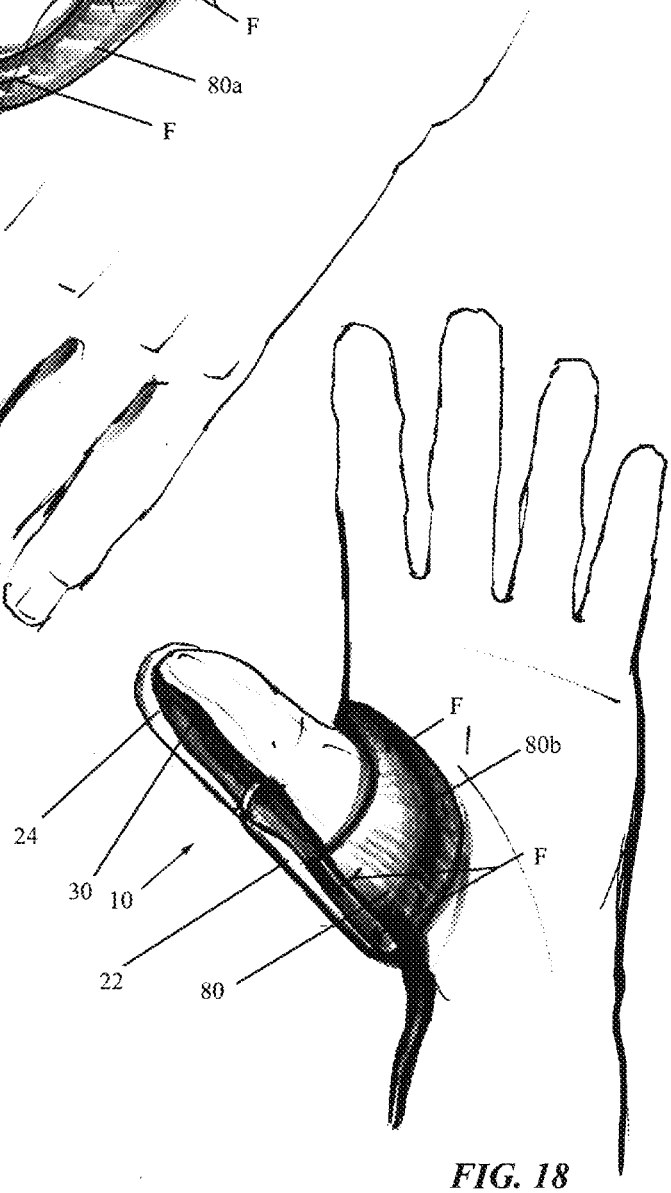
FIG. 18 is a perspective bottom view of the embodiment of FIG. 17.

In another embodiment of the present invention, digit shield 10 includes an integral elastomeric brace 80 for securing the shield 10 onto the thumb. Brace 80 may be a co-molded, insert-molded or over-molded elastomeric collar, or fabric strap attached to proximal portion 22 For example, as shown in FIGS. 17 and 18, brace 80 can be formed as a unitary partial-annular collar having terminal ends attached to proximal portion 22 on opposing lateral sides thereof adjacent to the metacarpal bone of the wearer's thumb. Alternatively, brace 80 can be formed as a fully-annular collar attached across the back of the proximal portion 22. As still another alternative, brace 80 comprises two opposing semi-annular tines attached to proximal portion 22 on opposing lateral sides thereof. One skilled in the art will appreciate that brace 80 and shield 10 may be a single unitary piece, or two or three nested or bonded pieces. When worn alone or incorporated into a protective sports glove, the brace 80 wraps around the base of the wearer's thumb. A dorsal portion 80*a* of brace 80 connects at its terminal end to proximal portion 22 of shield 10 and wraps over the back of the wearer's hand over the thumb and index crease of the wearer, as shown in FIG. 17, to the front of the wearer's hand where, as shown in FIG. 18, the anterior portion 80*b* of brace 80 wraps over a muscle in the base of the wearer's thumb and attaches at its second terminal end to proximal portion 22 of shield 10. This configuration allows brace 80 to rest into the thumb and index crease of the wearer's hand while in use. Upon lateral or longitudinal impact to the thumb, brace 80 distributes at least a portion of the forces therefrom down and across the muscle at the base of the thumb as indicated by the arrows, marked with reference character F, in FIGS. 17 and 18, before the tip of shield 10 touches the tip of the thumb. This redirection of forces helps to lessen any longitudinal "jamming" forces acting on the tip of the thumb and helps prevent fractures in the tip of the thumb.

Figure 13:
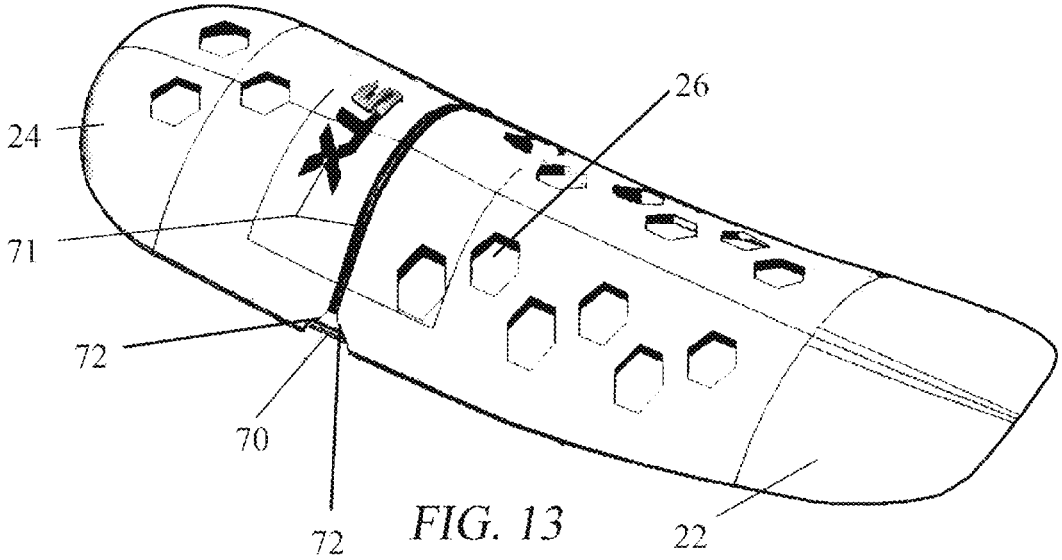
FIG. 13 is a perspective top view of an alternate embodiment according to the present invention.
Figure 14:
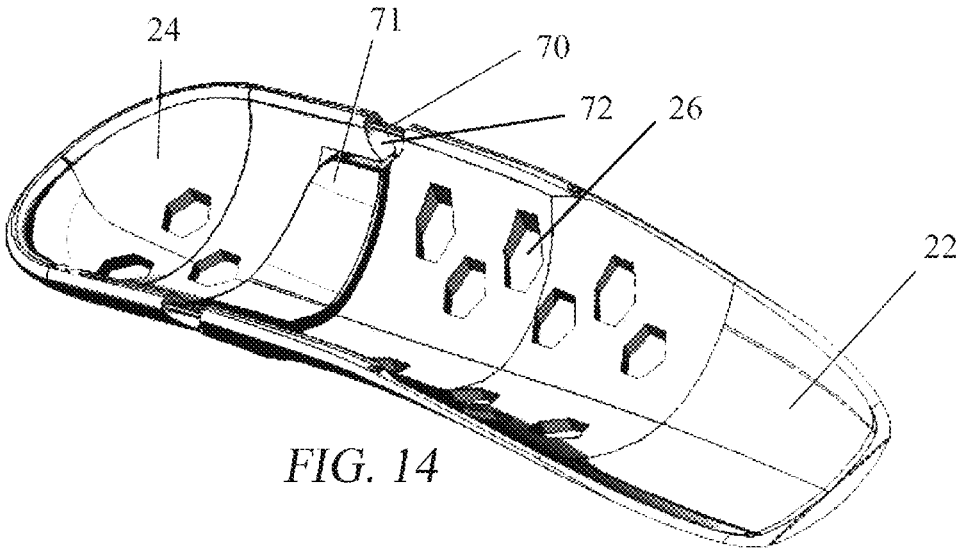
FIG. 14 is a perspective bottom view of the embodiment of FIG. 13.
Figure 15:
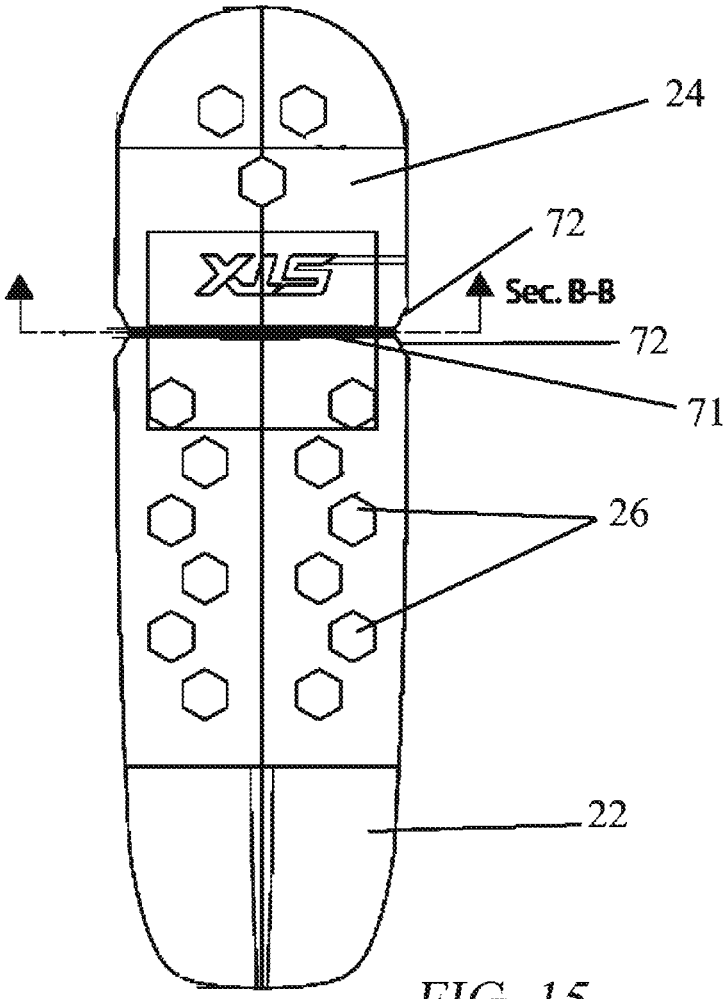
FIG. 15 is a top view of the embodiment of FIGS. 13-14.
Figure 16:
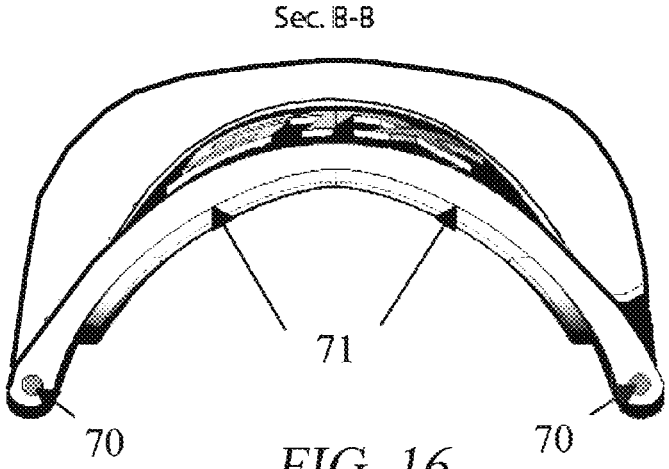
FIG. 16 is an end view of the embodiment of FIGS. 13-15.

With reference to FIGS. 13, 14, 15 and 16, an alternate embodiment of the present invention is depicted in which the distal and proximal portions, 24, 22 of the chassis are connected via a connection cable 70. In the instant embodiment, distal and proximal portions 24, 22 are formed to include notches, 72, on their outer edges proximate the joint between distal and proximal portions 24, 22 to facilitate rotation of the distal and proximal portions 24, 22 relative to each other corresponding to the movement of the digit within the glove. As shown in FIGS. 13 and 14, connection cable 70 spans the gap between distal and proximal portions 24, 22 formed by notches 72 at the outer edge of the joint between distal and proximal portions 24, 22. Connection cable 70 can be formed from any material that is flexible enough to bend along with the normal motion of the digit and also durable enough to withstand repeated bending in this manner, and also to resist overextension of the digit and to withstand repeated blows such as a player's hand might encounter during a hockey game from a hockey stick or the like. Preferably, connection cable 70 has a braided construction and can be formed from 304 Stainless Steel, any type of wire rope having a nylon coating thereon, or any other suitable material. Connection cable 70 may be formed within shield 10 by injection in-molding/co-molding or any other means known in the art suitable for same. Connection cable 70 may span only the distance between distal and proximal portions 24, 22 formed by notches 72, as shown in FIGS. 13 and 14, or, alternatively, connection cable 70 may form a single loop around the entire perimeter of chassis 20 including distal and proximal portions 24, 22. FIG. 16 shows a cross section of chassis 20 at section B-B of FIG. 15, and illustrates how connection cable 70 may be formed within the peripheral edges of distal and proximal portions 24, 22.

As shown in FIGS. 13, 14, 15 and 16, connection cable 70 may completely replace framework 30, thereby providing a lighter-weight and more cost effective, yet still durable, means of joining distal and proximal portions 24, 22 which also advantageously resists overextension of the digit while in use in a sports glove. Alternatively, connection cable 70 may be integrally formed within framework 30 (not shown in the figures) to either span hinge 42 or hinge 45 or to completely encircle chassis 20 as described above. The incorporation of connection cable 70 into framework 30 in the previously-described embodiments of the present invention would add durability to the overall structure of shield 10, particularly at the joint between distal and proximal portions 24, 22, where the majority of the stress on the shield 10 would be concentrated. In yet another embodiment of the present invention, connection cable 70 may be used in conjunction with gasket 71 to form the joint between distal and proximal portions 24, 22. Gasket 71 is preferably formed of shock absorbing material preferably constructed by injection molding or other known process from a relatively rigid, hard plastic polymer such as a thermoplastic polyurethane (TPU) in the nature of Ethylene-vinyl acetate (EVA). Polyvinyl chloride (PVC), polyethylene, acrylonitrile butadiene styrene (ABS) and polypropylene may also be used to form gasket 71. Gasket 71 may be over-molded or adhered/press-fit into channel 27 as shown in FIG. 14 to form a portion of the joint between distal and proximal portions 24, 22. As shown in FIGS. 13 and 14, gasket 71 may be formed on the concave underside of chassis 20 such that gasket 71 contours to fit the shape of channel 27. Gasket 71 may have a negligible thickness, and may span the distance along the joint between distal and proximal portions 24, 22 between notches 72 running perpendicular to the longitudinal axis of chassis 20, with a width large enough to overhang the joint between distal and proximal portions 24, 22 such that it achieves sufficient contact with both distal and proximal portions 24, 22 to be secured thereon by one of the methods described herein with reference to its formation. Also as shown in FIG. 13, gasket 71 may include a portion that fits between distal and proximal portions 24, 22 such that distal and proximal portions 24, 22 are not in contact at any point along the joint between them. Thus, gasket 71 may protrude through chassis 20 via the joint between distal and proximal portions 24, 22 and be partially visible on the convex top side of chassis 20.

It should now be apparent that the above-described digit shield 10 for incorporation into a protective sports glove allows a user to flex the digits/thumb as necessary for game play while dissipating the redirecting the energy of both longitudinal and lateral impacts away from the digit/thumb within the glove. The foregoing disclosure of embodiments of the present invention has been presented for purposes of illustration and description. It is not intended to be exhaustive or to limit the invention to the precise forms disclosed. Many variations and modifications of the embodiments described herein will be obvious to one of ordinary skill in the art in light of the above disclosure. The scope of the invention is to be defined only by the claims, and by their equivalents.

What is claimed is:

1. A protective sports glove, comprising:

a thumb receiving portion, said thumb receiving portion comprising a fabric layer disposed on a front side of said thumb receiving portion, padding disposed on a back side of said thumb receiving portion, and a digit shield engaged there between, said digit shield further comprising a chassis defining an arcuate channel having a longitudinal axis, said chassis comprising at least two discrete portions inclusive of a proximal portion and a distal portion in cooperative alignment along said axis to form said channel between opposing longitudinal edges, said proximal and distal portions each further comprising a cooperatively aligned lateral edge extending between said opposing longitudinal edges, said proximal and distal portions separated by a gap between said lateral edges, and an elastomeric energy absorbing portion, said energy absorbing portion comprising a perimeter portion affixed along at least a portion of said longitudinal edges of said channel to form on a first longitudinal edge a first hinge and on a second longitudinal edge a second hinge, said first and second hinges rotatably joining said distal portion to said proximal portion;

wherein said distal portion is permitted to rotate about said first and second hinges from a home position in a first direction but is substantially prevented from rotating about said first and second hinges from said home position in a second direction.

2. The protective sports glove of claim 1, wherein said chassis is formed by injection molding.

3. The protective sports glove of claim 1 wherein said chassis is formed from a hard plastic polymer such as a thermoplastic polyurethane (TPU), polyvinyl chloride (PVC), polyethylene, acrylonitrile butadiene styrene (ABS), or polypropylene.

4. The protective sports glove of claim 1, wherein said elastomeric energy absorbing portion further comprises:

a first damping element portion extending along said lateral edge of said proximal portion from said first hinge to said second hinge, and a second damping element portion extending along said lateral edge of said distal portion from said first hinge to said second hinge, whereby said distal portion is substantially prevented from rotating about said first and second hinges from said home position in said second direction by engagement of said first damping element portion with said second damping element portion.

5. The protective sports glove of claim 4, wherein said first and second damping element portions further comprise an energy dissipation block integrally formed with each of said first and second damping element portions, and wherein said energy dissipation blocks are situated in a recess formed in a convex surface of said distal and proximal portions and adjacent to said lateral edges of said distal and proximal portions.

6. The protective sports glove of claim 4, wherein said first and second hinges further comprise:

a second channel formed through said elastomeric energy absorbing portion at the point of rotation of said distal portion relative to said proximal portion; and a pair of shoulders formed on each of said opposing longitudinal edges of each of said proximal and distal portions and bordering said second channel;

whereby said second channel and said shoulders provide said gap between said distal portion and said proximal portion; and whereby said distal portion is prevented from overrotating past said longitudinal axis beyond said home position by engagement of said shoulders form on said distal portion with said shoulders formed on said proximal portion.

7. The protective sports glove of claim 4, wherein said first and second hinges further comprises a braided cable that forms at least a portion of a joint between said distal portion and said proximal portion along said longitudinal edges of said distal portion and said proximal portion.

8. The protective sports glove of claim 7, wherein said braided cable is formed in said chassis using either an in-molding or co-molding process.

9. The protective sports glove of claim 7, wherein said braided cable is constructed of stainless steel.

10. The protective sports glove of claim 7, further comprising a brace formed as a collar at least partially encircling an axis substantially parallel to the longitudinal axis of said chassis.

11. The digit shield of claim 10, wherein said brace comprises a partial-annular collar having ends affixed to said chassis.

12. The digit shield of claim 10, wherein said brace comprises two opposing tines each affixed at one end to said chassis.

13. A protective sports glove, comprising:

a thumb receiving portion, said thumb receiving portion comprising a fabric layer disposed on a front side of said thumb receiving portion, padding disposed on a back side of said thumb receiving portion, and a digit shield engaged there between, said digit shield further comprising a chassis defining an arcuate channel having a longitudinal axis, said chassis comprising at least two discrete portions inclusive of a proximal portion and a distal portion in cooperative alignment along said axis to form said channel between opposing longitudinal edges, said proximal and distal portions each further comprising a cooperatively aligned lateral edge extending between said opposing longitudinal edges, said proximal and distal portions separated by a gap between said lateral edges, and a braided cable that attaches along at least a portion of said longitudinal edges of said distal portion and said proximal portion to form on a first longitudinal edge a first hinge and on a second longitudinal edge a second hinge, said first and second hinges rotatably joining said distal portion to said proximal portion;

whereby said distal portion is permitted to rotate about said first and second hinges relative to said proximal portion from a home position in which said opposing longitudinal edges of said proximal and distal portions are cooperatively aligned, and is permitted to return to said home position.

14. The protective sports glove of claim 13, wherein said braided cable is formed in said chassis using either an in-molding or co-molding process.

15. The protective sports glove of claim 13, wherein said braided cable is constructed of 304 Stainless Steel.

16. The protective sports glove of claim 13, wherein said braided cable attaches along the entire portion of said longitudinal edges of said distal portion and said proximal portion to form a perimeter around said chassis.

17. The protective sports glove of claim 13, further comprising an energy absorbing gasket formed of an elastomeric material, said energy absorbing gasket being seated in the concave channel of said hard-shell chassis and extending between said distal portion and said proximal portion to cover said lateral edges of said distal portion and said lateral portion;

whereby said energy absorbing gasket prevents said distal portion from coming into direct contact with said proximal portion.

18. The protective sports glove of claim 17, wherein said braided cable attaches along the entire portion of said longitudinal edges of said distal portion and said proximal portion to form a perimeter around said chassis.

19. The protective sports glove of claim 17, wherein said gasket is attached to said chassis by one of over-molding or press-fitting.

20. The protective sports glove of claim 19, wherein said attachment means serves to attach said gasket to said distal and said proximal portions.

21. The protective sports glove of claim 19, wherein said attachment means serves to attach said gasket to only said distal portion.

22. The protective sports glove of claim 19, wherein said attachment means serves to attach said gasket to only said proximal portion.

23. The protective sports glove of claim 17, further comprising a brace formed as a collar at least partially encircling an axis substantially parallel to the longitudinal axis of said chassis.

24. The protective sports glove of claim 23, wherein said brace comprises a partial-annular collar having ends affixed to said chassis.

25. The protective sports glove of claim 23, wherein said brace comprises two opposing tines each affixed at one end to said chassis.

* * * * *